US011486600B2

(12) United States Patent
Takagi et al.

(10) Patent No.: US 11,486,600 B2
(45) Date of Patent: Nov. 1, 2022

(54) AIR CONDITIONER

(71) Applicant: Mitsubishi Electric Corporation, Tokyo (JP)

(72) Inventors: Tomoyuki Takagi, Tokyo (JP); Toshiya Sugiyama, Tokyo (JP); Keishi Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 76 days.

(21) Appl. No.: 16/982,098

(22) PCT Filed: Mar. 26, 2018

(86) PCT No.: PCT/JP2018/012141
§ 371 (c)(1),
(2) Date: Sep. 18, 2020

(87) PCT Pub. No.: WO2019/186648
PCT Pub. Date: Oct. 3, 2019

(65) Prior Publication Data

US 2021/0108823 A1 Apr. 15, 2021

(51) Int. Cl.
*F24F 11/88* (2018.01)
*F24F 11/33* (2018.01)
(Continued)

(52) U.S. Cl.
CPC ..... *F24F 11/88* (2018.01); *F24F 1/20* (2013.01); *F24F 11/33* (2018.01); *F24F 11/89* (2018.01)

(58) Field of Classification Search
CPC .. F24F 11/88; F24F 11/89; F24F 11/30; F24F 1/20
(Continued)

(56) References Cited

U.S. PATENT DOCUMENTS

2004/0074255 A1* 4/2004 Goto ..... B60H 1/00428 62/228.1
2018/0278049 A1* 9/2018 Sakurai ..... H02H 9/001
2022/0018563 A1* 1/2022 Liu ..... H02M 7/02

FOREIGN PATENT DOCUMENTS

EP 2241831 A1 3/2010
JP H07-158942 A 6/1995
(Continued)

OTHER PUBLICATIONS

Extended European Search Report dated Jun. 14, 2021 issued in corresponding European Patent Application No. 18911575.1.
(Continued)

*Primary Examiner* — Nelson J Nieves
(74) *Attorney, Agent, or Firm* — Posz Law Group, PLC

(57) ABSTRACT

An air conditioner includes an indoor unit and an outdoor unit. The outdoor unit includes: a DC motor; an inrush-current prevention relay having a coil and a contact provided on a supply line of an AC power supply as a power supply of the outdoor unit, in which the contact is in an electrically-disconnected state when any current does not flow through the coil and is in an electrically-connected state when a current flows through the coil; a PTC connected in parallel to the contact; and a temperature protector provided on a supply line of a relay-driving power supply as a power supply of the inrush-current prevention relay, which is in an electrically-connected state when a temperature of the DC motor is lower than a predetermined temperature, but is in an electrically-disconnected state when the temperature of the DC motor reaches a predetermined temperature or higher.

12 Claims, 5 Drawing Sheets

(51) Int. Cl.
*F24F 11/89* (2018.01)
*F24F 1/20* (2011.01)

(58) Field of Classification Search
USPC ..... 62/228.1
See application file for complete search history.

(56) References Cited

FOREIGN PATENT DOCUMENTS

| | | | | | |
|---|---|---|---|---|---|
| JP | 2004-112929 | A | | 4/2004 | |
| JP | 2006-204050 | A | | 8/2006 | |
| JP | 2006-304557 | A | | 11/2006 | |
| JP | 4318662 | B2 | | 8/2009 | |
| JP | 2010038484 | A | * | 2/2010 | |
| JP | 2010-243051 | A | | 10/2010 | |
| JP | 2010243051 | A | * | 10/2010 | ..... F24F 1/0003 |
| JP | 2011069538 | A | * | 4/2011 | ..... F24F 11/008 |
| JP | 2012202620 | A | * | 10/2012 | |
| JP | 2012-228009 | A | | 11/2012 | |
| JP | 2014015963 | A | * | 1/2014 | |
| JP | 2014-62475 | A | | 4/2014 | |
| JP | 6064481 | B2 | | 1/2017 | |
| JP | 2019011904 | A | * | 1/2019 | ..... F24F 1/20 |

OTHER PUBLICATIONS

Japanese Office Action dated Apr. 6, 2021, issued in corresponding Japanese Patent Application No. 2020-510197 (and English Machine Translation).

International Search Report of the International Searching Authority dated May 22, 2018 for the corresponding International application No. PCT/JP2018/012141 (and English translation).

Japanese office Action dated Jan. 26, 2021, issued in corresponding JP Patent Application No. 2020-510197 (and English Machine Translation).

Office Action dated Aug. 19, 2021, issued in corresponding IN Patent Application No. 202027037977 (and English Machine Translation).

Office Action dated Sep. 24, 2021, issued in corresponding AU Patent Application No. 2018417096.

* cited by examiner

AIR CONDITIONER

CROSS REFERENCE TO RELATED APPLICATION

This application is a U.S. national stage application of International Patent Application No. PCT/JP2018/012141 filed on Mar. 26, 2018, the disclosure of which is incorporated herein by reference.

TECHNICAL FIELD

The present invention relates to an air conditioner that executes temperature protection control of a motor.

BACKGROUND

In conventional temperature protection control of a DC (Direct Current) motor, a temperature protector is attached to the DC motor, and power supply of a motor driving element is shut down when the temperature of a winding of the DC motor reaches a predetermined temperature or higher. Due to this operation, the motor driving element is forcibly stopped to stop the operation of the DC motor, thereby protecting the DC motor (see, for example, Patent Literature 1).

Patent Literature

Patent Literature 1: Japanese Patent Application Laid-open No. 2012-228009

In the technique described in Patent Literature 1 described above, when a temperature abnormality caused by abnormal heat generation in a winding of a DC motor occurs, the power supply of a motor driving element is shut down, to forcibly stop the motor driving element and stop the operation of the DC motor. In such stoppage operation, however, functions other than the motor driving element are still in an operable state. Usually, while the power supply of the motor driving element is shut down, the motor driving element is opened, and therefore a path of an electric current to the DC motor is not formed and so any current does not flow to the DC motor. However, even while the power supply of the motor driving element is shut down, in a case where the motor driving element is short-circuited and a path of an electric current to the DC motor is formed, a current can flow to the DC motor if a power-supply voltage that is a source of a driving voltage for the DC motor is applied to the motor driving element. This situation has been problematic.

SUMMARY

The present invention has been achieved in view of the above circumstances, and an object of the present invention is to provide an air conditioner that is capable of, in a case where a temperature abnormality due to abnormal heat generation in a motor is caused, preventing a current from flowing to the motor even if a motor driving element is short-circuited.

In order to solve the above-mentioned problems and achieve the object, the present invention provides an air conditioner comprising an indoor unit and an outdoor unit, wherein the outdoor unit includes: a motor; a first relay including a first coil part and a first contact part provided on a supply line of an alternating current power supply that is a power supply of the outdoor unit, in which the first contact part is placed in an electrically-disconnected state when any current does not flow through the first coil part and the first contact part is placed in an electrically-connected state when a current flows through the first coil part; a PTC (Positive Temperature Coefficient) connected in parallel to the first contact part; and a temperature protector provided on a supply line of a relay-driving power supply that is a power supply of the first relay and provided to the motor, which is in an electrically-connected state when a temperature of the motor is lower than a predetermined temperature, and is placed in an electrically-disconnected state when the temperature of the motor reaches a predetermined temperature or higher.

The air conditioner according to the present invention has an advantageous effect that, in a case where a temperature abnormality is caused by abnormal heat generation in a motor, it is possible to prevent a current from flowing to the motor even if a motor driving element is short-circuited.

DETAILED DESCRIPTION

An air conditioner according to embodiments of the present invention will be described in detail below with reference to the drawings. The present invention is not necessarily limited by these embodiments.

First Embodiment

Figure 1:
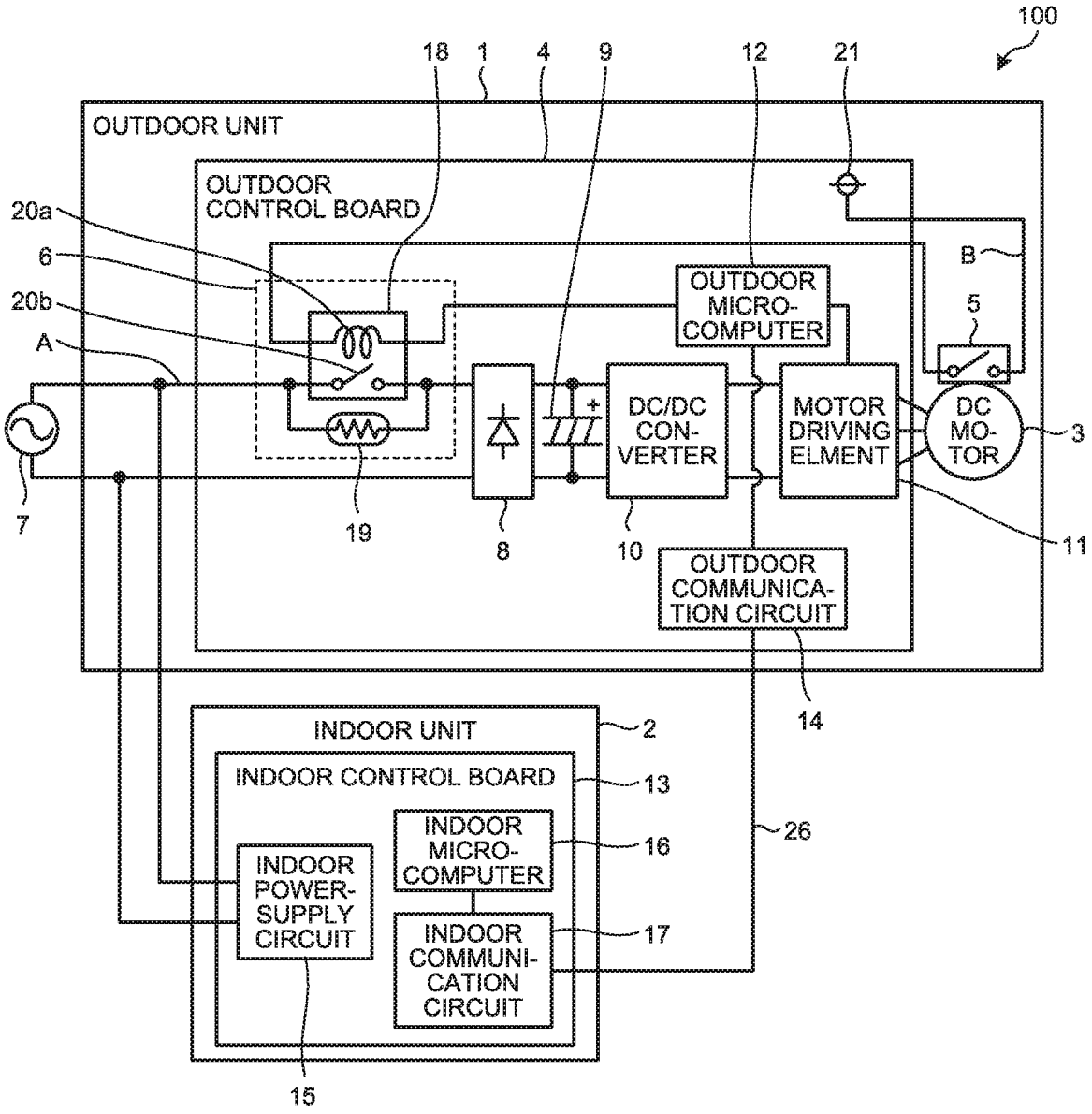
FIG. 1 is a schematic configuration diagram illustrating an example of an air conditioner according to a first embodiment of the present invention.

First of all, an air conditioner according to a first embodiment of the present invention is described. FIG. 1 is a schematic configuration diagram illustrating an example of the air conditioner according to the first embodiment of the present invention.

An air conditioner 100 illustrated in FIG. 1 includes an outdoor unit 1 and an indoor unit 2. The outdoor unit 1 includes a DC motor 3 such as a compressor motor or a fan motor, an outdoor control board 4 configured to control the DC motor 3, and a temperature protector 5 configured to protect the DC motor 3 against a temperature abnormality. The outdoor unit 1 may include an AC (Alternating Current) motor, for example, in place of the DC motor 3.

The outdoor control board 4 includes an inrush-current prevention circuit 6 configured to protect the outdoor control board 4 against an inrush current, a diode bridge 8 configured to rectify an AC current supplied from an AC power supply 7, an electrolytic capacitor 9 that accumulates electric charges therein, and a DC/DC converter 10. The DC/DC converter 10 converts an applied DC voltage into a low DC voltage for causing each part on the outdoor control board 4 to operate, and converts the applied DC voltage into a DC voltage that is used as a source to be converted to a driving voltage by a motor driving element 11. The DC voltage having a low voltage value, which has been generated by the DC/DC converter 10 is applied to each part on the outdoor control board 4 through a path not illustrated in FIG. 1. The outdoor control board 4 includes the motor driving element 11 configured to drive the DC motor 3, an outdoor microcomputer 12 configured to transmit a driving instruction signal for the DC motor 3 to the motor driving element 11 and control the inrush-current prevention circuit 6, and an outdoor communication circuit 14 configured to transmit information to and receive information from an indoor control board 13 described later.

The indoor unit 2 includes the indoor control board 13. The indoor control board 13 includes an indoor power-supply circuit 15 configured to convert the AC power supply 7 into a power supply for causing each part on the indoor control board 13 to operate, an indoor microcomputer 16 configured to control functions of the indoor unit 2, and an indoor communication circuit 17 configured to transmit information to and receive information from the outdoor control board 4. The outdoor unit 1 and the indoor unit 2 are connected to each other through the outdoor communication circuit 14, an indoor-outdoor communication line 26, and the indoor communication circuit 17.

The inrush-current prevention circuit 6 includes an inrush-current prevention relay 18 and a PTC (Positive Temperature Coefficient) 19 connected in parallel to a contact part 20*b* of the inrush-current prevention relay 18. The PTC 19 is a PTC thermistor, for example. The inrush-current prevention relay 18 has a configuration in which a relay-driving power supply 21 is connected to one end of a coil part 20*a* through the temperature protector 5, the outdoor microcomputer 12 is connected to the other end of the coil part 20*a*, and the contact part 20*b* is brought into an electrically-connected state when an electric current is caused to flow through the coil part 20*a* by control of the outdoor microcomputer 12, and is brought into an electrically-disconnected state when an electric current is not caused to flow through the coil part 20*a*. The contact part 20*b* is provided on a supply line A of the AC power supply 7 on the outdoor control board 4. The inrush-current prevention relay 18 corresponds to a first relay. The coil part 20*a* corresponds to a first coil part. The contact part 20*b* corresponds to a first contact part.

The temperature protector 5 is in a state where both ends of the protector are electrically connected to each other when the temperature of an object is lower than a predetermined temperature, but cuts off the electrical connection between the both ends to enter into the electrically-disconnected state when the temperature of the object reaches a predetermined temperature or higher. The temperature protector 5 is attached to an outer wall, a winding, or the like of the DC motor 3 as the object to be protected. The temperature protector 5 has one end connected to the coil part 20*a* and the other end connected to the relay-driving power supply 21. The temperature protector 5 is provided on a supply line B of the relay-driving power supply 21. The temperature protector 5 may be connected to the coil part 20*a* at one end thereof and to the outdoor microcomputer 12 at the other end thereof. The temperature protector 5 is, for example, a thermostat. The temperature protector 5 is not limited to a type of a switch, and may be a type in which the electrical connection between both terminals thereof is cut off depending on the temperature such as a thermal fuse.

Figure 2:
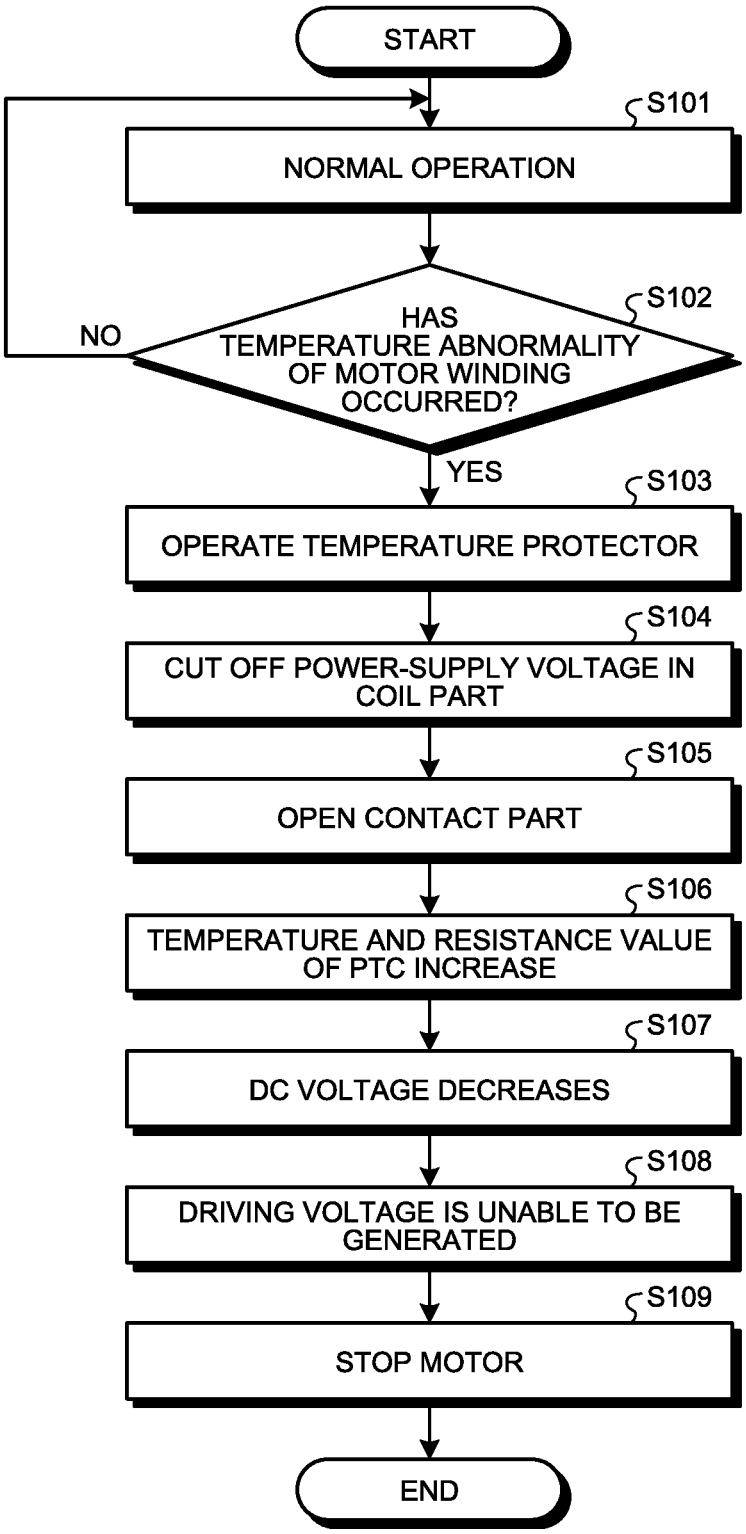
FIG. 2 is a flowchart of a process of detecting a temperature abnormality of a winding of a DC motor to stop the DC motor, which is performed by an outdoor unit illustrated in FIG. 1.

FIG. 2 is a flowchart of a process of detecting a temperature abnormality of a winding of a DC motor to stop the DC motor, which is performed by an outdoor unit illustrated in FIG. 1.

In the outdoor unit 1, when an AC current is supplied from the AC power supply 7 to the outdoor control board 4, the supplied AC current passes through the PTC 19 of the inrush-current prevention circuit 6 and is then rectified by the diode bridge 8, and electric charges are accumulated in the electrolytic capacitor 9. In this situation, an AC voltage applied from the AC power supply 7 to the outdoor control board 4 is converted into a DC voltage.

The DC voltage obtained by the conversion is converted by the DC/DC converter 10 into a DC voltage having a low voltage value, required for operations of elements such as the outdoor microcomputer 12, the motor driving element 11, and the outdoor communication circuit 14, and is applied to parts constituting elements such as the outdoor microcomputer 12, the motor driving element 11, and the outdoor communication circuit 14. The power-supply voltage of the relay-driving power supply 21 is also a DC voltage having a low voltage value and is generated by the DC/DC converter 10.

When the generated low DC voltage is applied to the outdoor microcomputer 12, the outdoor microcomputer 12 is activated. The outdoor microcomputer 12 executes control in such a manner that the power-supply voltage of the relay-driving power supply 21 is applied to the coil part 20*a* and an electric current flows through the coil part 20*a*. Accordingly, the contact part 20*b* forms connection, so that the AC current that has been supplied to the diode bridge 8 through the PTC 19 starts to be supplied to the diode bridge 8 through the contact part 20*b*, and then the path of the AC current is switched.

Usually, a time to switch over the path of the AC current requires only about one to two seconds. Therefore, the amount of heat generation of the PTC 19 is not so large, and the resistance value of the PTC 19 does not reach a level at which supply of the AC current to the inrush-current prevention circuit 6 and its subsequent units is shut down.

After the path of the AC current is switched over, a DC motor driving signal is transmitted from the outdoor microcomputer 12 to the motor driving element 11, and a DC voltage different from the low DC voltage described above, which has been generated by the DC/DC converter 10, is converted by the motor driving element 11 into a driving voltage for causing the DC motor 3 to rotate. Application of the driving voltage to the DC motor 3 causes the DC motor 3 to rotate. The outdoor unit 1 performs a normal operation in this manner (Step S101).

While a temperature abnormality caused by abnormal heat generation in a winding of the DC motor 3 does not occur (NO at Step S102), the outdoor unit 1 performs a normal operation (Step S101).

When a temperature abnormality caused by the abnormal heat generation in the winding of the DC motor 3 occurs (YES at Step S102), the temperature protector 5 operates (Step S103), so that the electrical connection between both ends of the temperature protector 5 is cut off and the power-supply voltage of the relay-driving power supply 21 applied to the coil part 20*a* is cut off (Step S104). Accordingly, the contact part 20*b* is opened (Step S105).

Because the path of the AC current is switched from a path passing through the contact part 20*b* to a path passing through the PTC 19, the temperature and the resistance value of the PTC 19 increase (Step S106) and a voltage drop in the PTC 19 becomes larger. Accordingly, the AC current is no longer supplied to the inrush-current prevention circuit 6 and its subsequent units, so that electric charges cannot be accumulated in the electrolytic capacitor 9 and a DC voltage applied to the DC/DC converter 10 decreases (Step S107).

When the DC voltage applied to the DC/DC converter 10 decreases, the DC voltage applied to the motor driving element 11 also decreases, and the motor driving element 11 cannot generate a driving voltage (Step S108) and so the DC motor 3 is stopped (Step S109). The DC/DC converter 10 also becomes unable to generate the low DC voltage required for the operations of the outdoor microcomputer 12, the motor driving element 11, and the outdoor communication circuit 14, and then the outdoor unit 1 is stopped.

When the power supply to the DC motor 3 is stopped and any current does not flow through the winding of the DC motor 3, the temperature of the winding of the DC motor 3 decreases, and the temperature protector 5 is returned to a state where both ends thereof are electrically connected to each other. If the temperature protector 5 is a thermal fuse, it is not returned to its original state.

Even if the temperature of the PTC 19 decreases and the resistance value of the PTC 19 is reduced to a value at which a current flows therethrough, the power-supply voltage of the relay-driving power supply 21 is not generated by the DC/DC converter 10, and therefore the contact part 20*b* remains opened even after the temperature protector 5 is returned to the state where the both ends of the protector are electrically connected to each other. Therefore, even if accumulation of electric charges in the electrolytic capacitor 9 starts again, an AC current flows through the PTC 19, thereby causing the temperature of the PTC 19 to rise immediately and causing the resistance value thereof to increase to a value at which a current flow is stopped. As a result of this, accumulation of electric charges into the electrolytic capacitor 9 is stopped. Restart and stop of accumulation of electric charges in the electrolytic capacitor 9 are repeated, and the DC voltage applied to the DC/DC converter 10 does not increase to the DC voltage required for voltage conversion of the DC/DC converter 10. For this reason, the DC/DC converter 10 cannot generate the low DC voltage required for the operations of the outdoor microcomputer 12 and so on, and the DC voltage that is a source for conversion of the driving voltage by the motor driving element 11. This means that the outdoor unit 1 of the air conditioner 100 does not restart its operation unless the AC current supplied to the outdoor control board 4 is cut off once by using a breaker or the like and the temperature of the PTC 19 decreases to a temperature substantially equivalent to the temperature at the operation start for a normal operation.

According to the process illustrated in FIG. 2, when a temperature abnormality caused by abnormal heat generation in the winding of the DC motor 3 occurs, any AC current is not supplied to the inrush-current prevention circuit 6 and its subsequent units. Therefore, even if the motor driving element 11 is short-circuited, any current does not flow to the DC motor 3, and a current flowing through the DC motor 3 can be cut off.

According to the present embodiment, the DC motor 3 is not stopped by control of the outdoor microcomputer 12. Therefore, even if a function of protecting the DC motor 3 using a program in the outdoor microcomputer 12 does not work for some reason such as a program runaway in the outdoor microcomputer 12, it is possible to stop the DC motor 3.

According to the present embodiment, a voltage applied across the temperature protector 5 is low, as compared with that in a configuration in which a path of an AC current supplied from the AC power supply 7 is disconnected directly by a temperature protector. In general, a component whose rated voltage is lower has a smaller component size and it is therefore possible to downsize the temperature protector 5.

Second Embodiment

Figure 3:
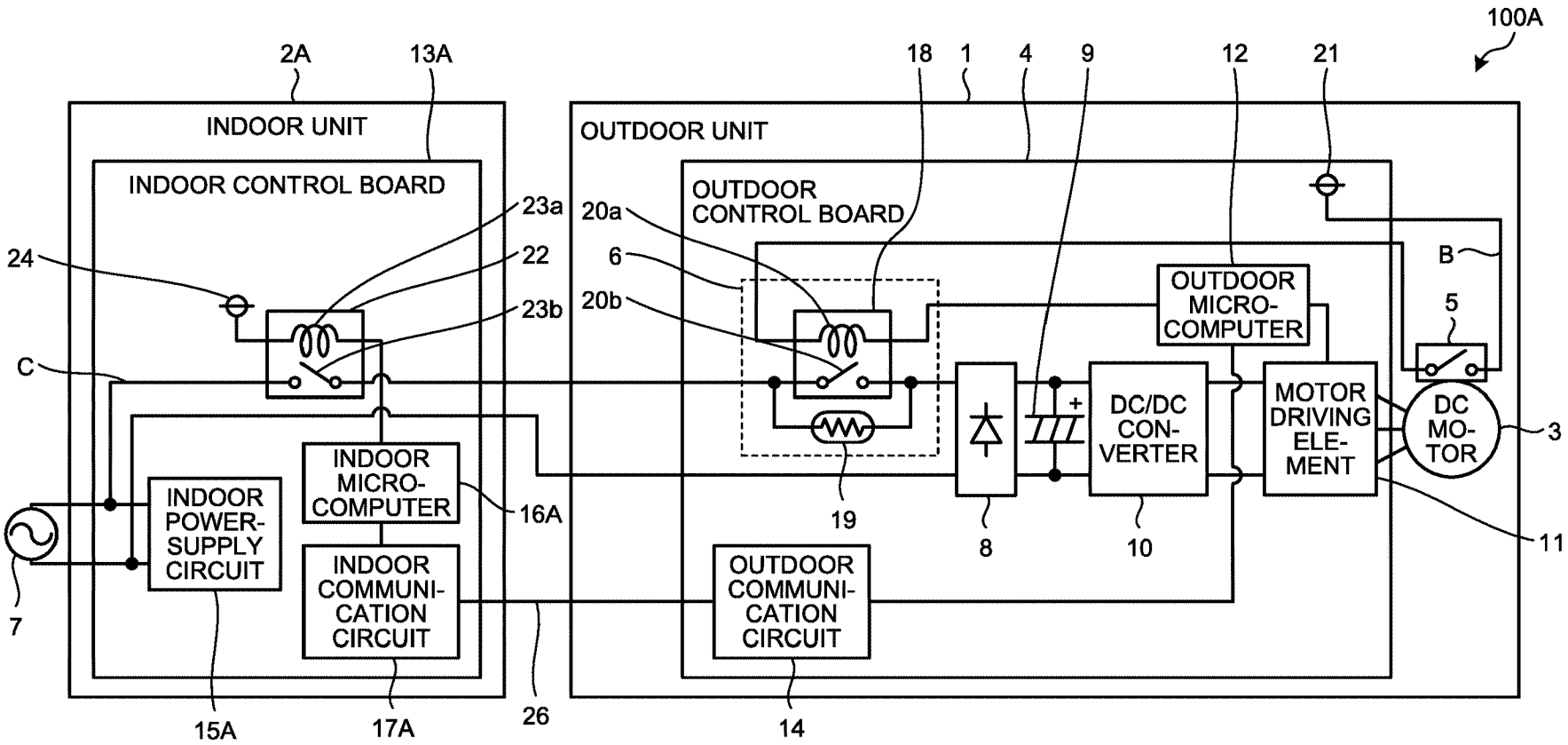
FIG. 3 is a schematic configuration diagram illustrating an example of an air conditioner according to a second embodiment of the present invention.

Next, an air conditioner according to a second embodiment of the present invention is described. FIG. 3 is a schematic configuration diagram illustrating an example of the air conditioner according to the second embodiment of the present invention. An air conditioner 100A according to the second embodiment of the present invention is different from the first embodiment described above mainly in that an AC current supplied from the AC power supply 7 is not directly supplied to an outdoor unit 1, but is supplied thereto through an indoor unit 2A. Descriptions of configurations and effects overlapping with those of the first embodiment are omitted, and configurations and effects different from those of the first embodiment are described below.

The air conditioner 100A illustrated in FIG. 3 includes the outdoor unit 1 and the indoor unit 2A. The indoor unit 2A includes an indoor control board 13A. The indoor control board 13A includes an indoor power-supply circuit 15A configured to convert the AC power supply 7 into a power supply for causing each part on the indoor control board 13A to operate, an indoor microcomputer 16A configured to control functions of the indoor unit 2A, and an indoor communication circuit 17A configured to transmit information to and receive information from the outdoor control board 4. The outdoor unit 1 and the indoor unit 2A are connected to each other through the outdoor communication circuit 14, the indoor-outdoor communication line 26, and the indoor communication circuit 17A.

The indoor control board 13A includes an outdoor power-supply relay 22. The outdoor power-supply relay 22 has a configuration in which a relay-driving power supply 24 is connected to one end of a coil part 23*a* and the indoor microcomputer 16A is connected to the other end of the coil part 23*a*, by which a contact part 23*b* is placed in an electrically-connected state when an electric current is caused to flow through the coil part 23*a* and the contact part 23*b* is placed in an electrically-disconnected state when an electric current is caused not to flow through the coil part 23*a* under control of the indoor microcomputer 16A. The contact part 23*b* is provided on a supply line C of the AC power supply 7 on the indoor control board 13A. The outdoor power-supply relay 22 corresponds to a second relay. The coil part 23*a* corresponds to a second coil part. The contact part 23*b* corresponds to a second contact part.

The present embodiment can obtain effects identical to those in the first embodiment of the present invention described above. Further, in the present embodiment, the contact part 23*b* of the outdoor power-supply relay 22 is provided on the supply line C of the AC power supply 7 on the indoor control board 13A. By this configuration, it is possible to cut off an AC current supplied to the outdoor control board 4 even if cutting-off of the AC current using a breaker or the like does not take place.

Third Embodiment

Figure 4:
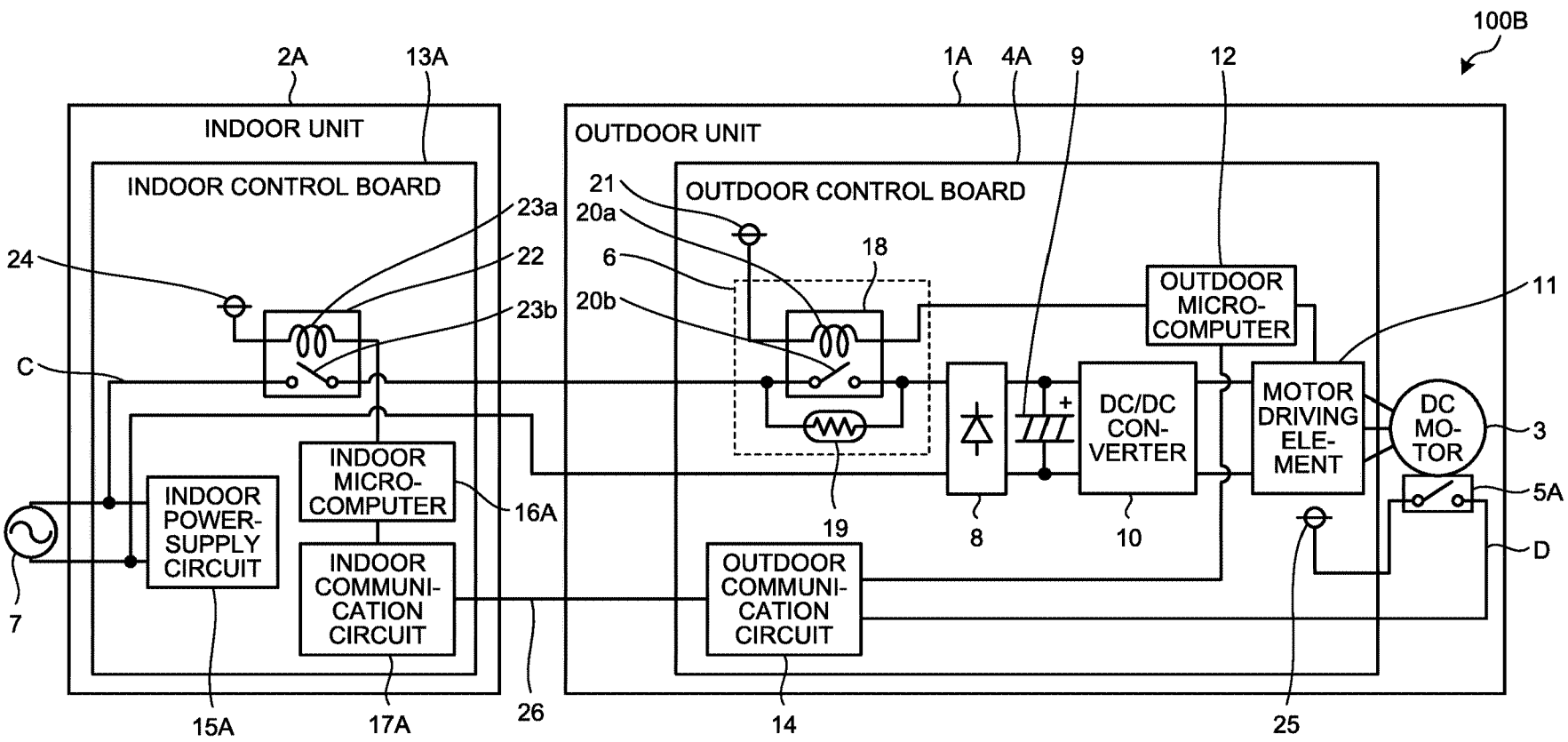
FIG. 4 is a schematic configuration diagram illustrating an example of an air conditioner according to a third embodiment of the present invention.

Next, an air conditioner according to a third embodiment of the present invention is described. FIG. 4 is a schematic configuration diagram illustrating an example of the air conditioner according to the third embodiment of the present invention. An air conditioner 100B according to the third embodiment of the present invention is different from the second embodiment described above mainly in that the temperature protector 5 is not provided between the relay-driving power supply 21 and the inrush-current prevention relay 18, and instead a temperature protector 5A is provided between a communication-circuit power supply 25 and the outdoor communication circuit 14. Descriptions of configurations and effects overlapping with those of the second embodiment are omitted and configurations and effects different from those of the second embodiment are described below.

The air conditioner 100B illustrated in FIG. 4 includes an outdoor unit 1A and the indoor unit 2A. The outdoor unit 1A includes the DC motor 3, an outdoor control board 4A, and the temperature protector 5A. The temperature protector 5A is attached to an outer wall, a winding, or the like of the DC motor 3. The temperature protector 5A is connected to the outdoor communication circuit 14 at one end thereof and to the communication-circuit power supply 25 at the other end thereof. The temperature protector 5A is provided on a supply line D of the communication-circuit power supply 25.

Figure 5:
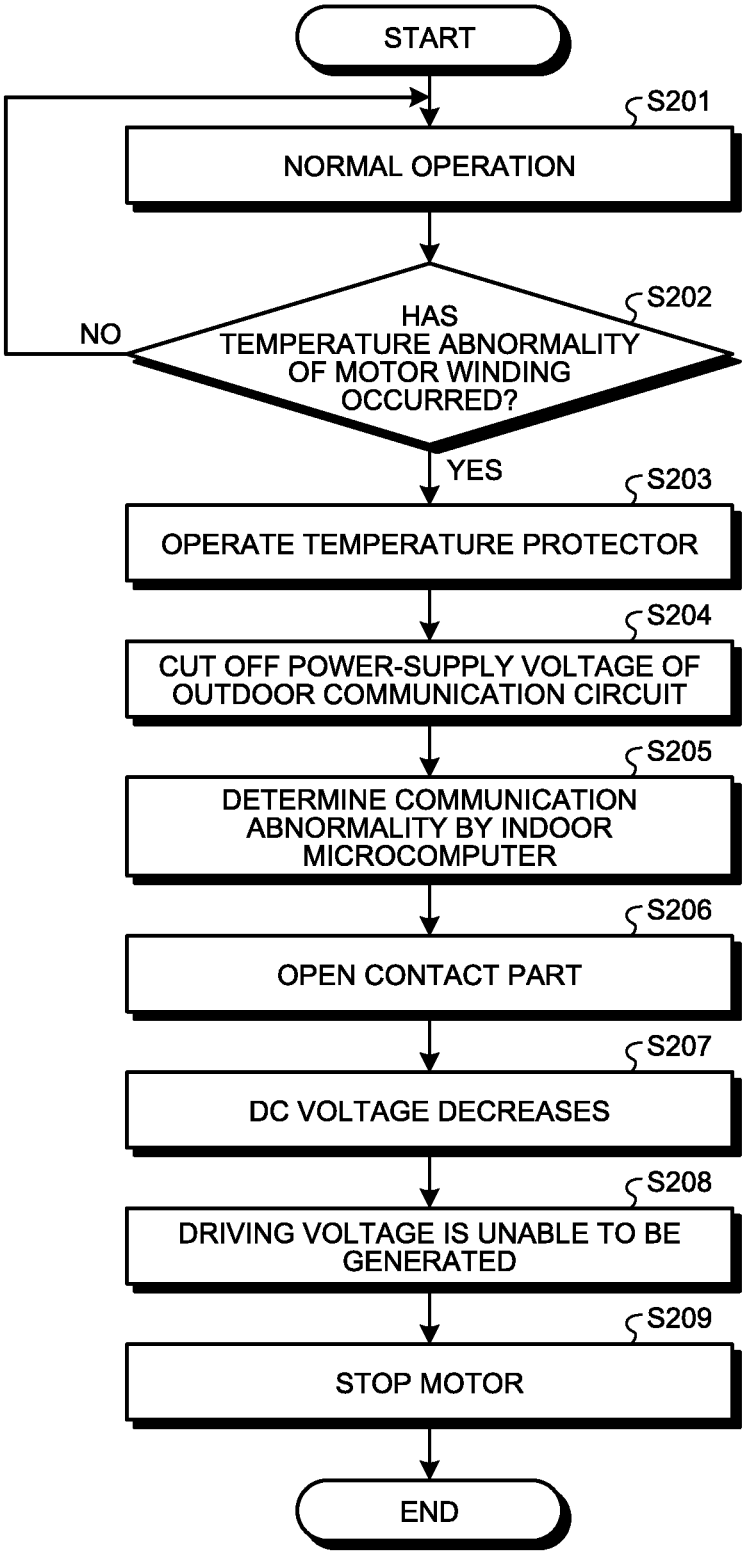
FIG. 5 is a flowchart of a process of detecting a temperature abnormality of a winding of a DC motor to stop the DC motor, which is performed by the air conditioner illustrated in FIG. 4.

FIG. 5 is a flowchart of a process of detecting a temperature abnormality of a winding of a DC motor to stop the DC motor, which is performed by the air conditioner illustrated in FIG. 4.

In the indoor unit 2A, an AC voltage applied to the indoor power-supply circuit 15A from the AC power supply 7 is converted by the indoor power-supply circuit 15A into a low DC voltage required for operations of elements such as the indoor microcomputer 16A and the indoor communication circuit 17A, and the DC voltage is applied to each part constituting elements such as the indoor microcomputer 16A and the indoor communication circuit 17A. The power-supply voltage of the relay-driving power supply 24 is also a low DC voltage and is generated by the indoor power-supply circuit 15A.

When the generated low DC voltage is applied to the indoor microcomputer 16A, the indoor microcomputer 16A is activated. The indoor microcomputer 16A executes control in such a manner that the power-supply voltage of the relay-driving power supply 24 is applied to the coil part 23*a* and an electric current flows through the coil part 23*a*. By this situation, the contact part 23*b* forms connection, and so an AC current is supplied to the outdoor unit 1A.

When the AC current is supplied to the outdoor unit 1A, the outdoor unit 1A performs a normal operation (Step S201) as in the first embodiment described above.

While a temperature abnormality caused by abnormal heat generation in a winding of the DC motor 3 does not occur (NO at Step S202), the outdoor unit 1A performs a normal operation (Step S201).

When a temperature abnormality caused by the abnormal heat generation in the winding of the DC motor 3 occurs (YES at Step S202), the temperature protector 5A operates (Step S203), so that the electrical connection between both ends of the temperature protector 5A is cut off and the power-supply voltage of the communication-circuit power supply 25 applied to the outdoor communication circuit 14 is cut off (Step S204). Accordingly, communication is not established between the outdoor communication circuit 14 and the indoor communication circuit 17A, and the indoor microcomputer 16A determines a communication abnormality (Step S205).

Upon determination of the communication abnormality, the indoor microcomputer 16A executes control in such a manner that the power-supply voltage of the relay-driving power supply 24 is not applied to the coil part 23*a*, thereby preventing a current from flowing through the coil part 23*a*. By this control, the contact part 23*b* is opened (Step S206), any AC current is not supplied to the outdoor unit 1A and electric charges cannot be accumulated in the electrolytic capacitor 9, so that a DC voltage applied to the DC/DC converter 10 decreases (Step S207).

When the DC voltage applied to the DC/DC converter 10 decreases, a DC voltage applied to the motor driving element 11 also decreases, so that the motor driving element 11 cannot generate a driving voltage (Step S208) and the DC motor 3 is stopped (Step S209). The DC/DC converter 10 also becomes unable to generate the low DC voltage required for the operations of the outdoor microcomputer 12, the motor driving element 11, and the outdoor communication circuit 14, and then the outdoor unit 1A is stopped.

When the power supply to the DC motor 3 is stopped and any current does not flow through the winding of the DC motor 3, the temperature of the winding of the DC motor 3 decreases, and the temperature protector 5A is returned to a state where both ends thereof are electrically connected to each other. If the temperature protector 5A is a thermal fuse, it is not returned to its original state.

However, because the power-supply voltage of the communication-circuit power supply 25 is not generated by the DC/DC converter 10, the outdoor communication circuit 14 does not become operable and communication is not established between the outdoor communication circuit 14 and the indoor communication circuit 17A even after the temperature protector 5A is returned to the state where the both ends of the protector are electrically connected to each other.

According to the process illustrated in FIG. 5, when a temperature abnormality caused by abnormal heat generation in a winding of the DC motor 3 occurs, an AC current is not supplied to the outdoor unit 1A. Therefore, even if the motor driving element 11 is short-circuited, any current does not flow to the DC motor 3, and a current flowing through the DC motor 3 can be cut off.

According to the present embodiment, the DC motor 3 is not stopped by control of the outdoor microcomputer 12. Therefore, even if a function of protecting the DC motor 3 using a program in the outdoor microcomputer 12 does not work for some reason, such as a program runaway in the outdoor microcomputer 12, it is possible to stop the DC motor 3.

According to the present embodiment, a voltage applied to both ends of the temperature protector 5A is low, as compared with that in a configuration in which a path of an AC current supplied from the AC power supply 7 is cut off directly by a temperature protector. In general, a component whose rated voltage is lower has a smaller component size and it is therefore possible to downsize the temperature protector 5A.

Although the temperature protector 5A is provided between the outdoor communication circuit 14 and the communication-circuit power supply 25 in the present embodiment, another configuration may be realized in which a temperature protector is provided on the indoor-outdoor communication line 26 and is attached to an outer wall, a winding, or the like of the DC motor 3. Also in this case, when the temperature protector is operated, communication is no longer established between the outdoor communication circuit 14 and the indoor communication circuit 17A, and the indoor microcomputer 16A can determine a communication abnormality, so that identical effects can be obtained.

The configurations described in the above embodiments are only examples of the content of the present invention. The configurations can be combined with other publicly known techniques, and partially omitted and/or modified without departing from the scope of the present invention.

The invention claimed is:

1. An air conditioner comprising an indoor unit and an outdoor unit, wherein the outdoor unit includes:
a motor;
a motor driving element connected to the motor, which drives the motor;
a converter connected to the motor driving element, which converts a voltage from an alternating current power supply that is a power supply of the outdoor unit and supplies a converted voltage to the motor driving element;
a first relay including a first coil part and a first contact part provided between the alternating current power supply and the converter, in which the first contact part is placed in an electrically-disconnected state when any current does not flow through the first coil part and the first contact part is placed in an electrically-connected state when a current flows through the first coil part;
a PTC (Positive Temperature Coefficient) connected in parallel to the first contact part; and
a temperature protector provided on a supply line of a relay-driving power supply that is a power supply of the first relay and that is provided separately from the alternating current power supply, which is in an electrically-connected state when a temperature of the motor is lower than a predetermined temperature, and is placed in an electrically-disconnected state when the temperature of the motor reaches the predetermined temperature or higher.

2. The air conditioner according to claim 1, wherein
the motor is a DC (Direct Current) motor, and
the PTC is a PTC thermistor.

3. The air conditioner according to claim 2, wherein
the temperature protector is attached to an outer wall of the motor or a winding of the motor.

4. The air conditioner according to claim 3, wherein
the indoor unit includes a second relay that includes a second coil part and a second contact part provided on the supply line of the alternating current power supply.

5. The air conditioner according to claim 2, wherein
the indoor unit includes a second relay that includes a second coil part and a second contact part provided on the supply line of the alternating current power supply.

6. The air conditioner according to claim 1, wherein
the temperature protector is attached to an outer wall of the motor or a winding of the motor.

7. The air conditioner according to claim 6, wherein
the indoor unit includes a second relay that includes a second coil part and a second contact part provided on the supply line of the alternating current power supply.

8. The air conditioner according to claim 1, wherein
the indoor unit includes a second relay that includes a second coil part and a second contact part provided on the supply line of the alternating current power supply.

9. An air conditioner comprising an indoor unit and an outdoor unit, wherein
the indoor unit includes:
a relay including a coil part and a contact part provided on a supply line of an alternating current power supply that is a power supply of the outdoor unit, in which the contact part is placed in an electrically-disconnected state when any current does not flow through the coil part and the contact part is placed in an electrically-connected state when a current flows through the coil part; and
an indoor communication circuit to communicate with the outdoor unit,
the outdoor unit is connected to the alternating current power supply through the contact part and includes:
a motor;
an outdoor communication circuit to communicate with the indoor unit; and
a temperature protector provided on a supply line of a communication-circuit power supply that is a power supply of the outdoor communication circuit, which is in an electrically-connected state when a temperature of the motor is lower than a predetermined temperature, and is in an electrically-disconnected state when the temperature of the motor reaches the predetermined temperature or higher, and
the indoor unit further includes:
an indoor microcomputer to control a current not to flow through the coil part when communication is not established between the outdoor communication circuit and the indoor communication circuit.

10. The air conditioner according to claim 9, wherein
when the temperature of the motor reaches the predetermined temperature or higher,
electrical connection between both ends of the temperature protector is cut off, thereby to cause a power-supply voltage of the communication-circuit power supply applied to the outdoor communication circuit to be cut off to cause electrical connection between the outdoor communication circuit and the indoor communication circuit to be cut off, and
communication between the outdoor unit and the indoor unit is not established and the indoor microcomputer executes control to prevent the power-supply voltage of the communication-circuit power supply from being applied to the coil part, thereby to result in the contact part being opened and power supply to the outdoor unit being stopped to stop the motor.

11. An air conditioner comprising an indoor unit and an outdoor unit, wherein the outdoor unit includes:
a motor;
a motor driving element connected to the motor, which drives the motor;
a converter connected to the motor driving element, which converts a voltage from an alternating current power supply that is a power supply of the outdoor unit and supplies a converted voltage to the motor driving element;
a first relay including a first coil part and a first contact part provided between the alternating current power supply and the converter, in which the first contact part is placed in an electrically-disconnected state when any current does not flow through the first coil part and the first contact part is placed in an electrically-connected state when a current flows through the first coil part;
a PTC (Positive Temperature Coefficient) connected in parallel to the first contact part; and
a temperature protector provided on a supply line of a relay-driving power supply that is a power supply of the first relay, which is in an electrically-connected state when a temperature of the motor is lower than a predetermined temperature, and is placed in an electrically-disconnected state when the temperature of the motor reaches the predetermined temperature or higher; wherein when the temperature of the motor reaches the predetermined temperature or higher, an electrical connection between both ends of the temperature protector is cut off, to cause a power-supply voltage of the relay-driving power supply applied to the first coil part to be cut off to cause the first contact part to be opened, and a path of the alternating current power supply is switched from a path passing through the first contact part to a path passing through the PTC, to result in a temperature and a resistance value of the PTC increasing to stop power supply to the motor and stop an operation of the motor.

12. The air conditioner according to claim 11, wherein the indoor unit includes a second relay that includes a second coil part and a second contact part provided on the supply line of the alternating current power supply.

* * * * *